US005169516A

United States Patent [19]

Carr

[11] Patent Number: 5,169,516

[45] Date of Patent: Dec. 8, 1992

[54] REMOVAL OF ARSENIC COMPOUNDS FROM LIGHT HYDROCARBON STREAMS

[76] Inventor: Norman L. Carr, 550 Blazier Dr., Wexford, Pa. 15090

[21] Appl. No.: 753,184

[22] Filed: Aug. 30, 1991

Related U.S. Application Data

[63] Continuation-in-part of Ser. No. 738,204, Jul. 30, 1991, abandoned.

[51] Int. Cl.[5] ..... C10G 27/00

[52] U.S. Cl. ..... 208/189; 208/203; 208/206; 208/208 R; 208/246; 208/247; 208/251 R; 208/253; 208/301

[58] Field of Search ..... 208/99, 189, 203, 206, 208/208 R, 246, 247, 251 R, 253, 299, 301, 307

[56] References Cited

U.S. PATENT DOCUMENTS

| | | | |
|---|---|---|---|
| 3,542,669 | 11/1970 | DeFeo | 208/91 |
| 3,782,076 | 1/1974 | Carr et al. | 55/74 |
| 3,789,581 | 2/1974 | Carr et al. | 55/73 |
| 4,849,577 | 7/1989 | Boitisux | 505/820 |
| 5,064,525 | 11/1991 | Frame et al. | 208/189 |

OTHER PUBLICATIONS

Carr, N. L., D. L. Stahlfeld, H. G. Robertson, "Remove Arsine to Protect Catalyst", *Hydrocarbon Processing*, May 1985, pp. 100–102.

Kenneth H. Bacon, Alfred M. Henke, "Gasoline Sweetening Process With Molecular Sieves", Petroleum Refiner, Apr. 1961, pp. 109–112.

Levenspiel, O., "Chemical Reaction Engineering", John Wiley & Sons, Inc., 1972, pp. 260–263, 274–288.

*Primary Examiner*—Theodore Morris
*Assistant Examiner*—William C. Diemler
*Attorney, Agent, or Firm*—Buchanan Ingersoll

[57] ABSTRACT

A process for removal of arsenic from a hydrocarbon stream containing arsenic together with mercaptan and non-mercaptan sulfur compounds. The hydrocarbon stream is passed through at least two mercaptan oxidizing reactors in series wherein the mercaptans are oxidized to disulfides to produce a low mercaptan liquid containing no more than 1.5 ppm sulfur as mercaptans. The low mercaptan liquid is passed over an arsenic sorbent catalyst containing less than 20 weight percent gamma alumina to selectively sorb arsenic substantially without sorbing non-mercaptan sulfur compounds.

40 Claims, 1 Drawing Sheet

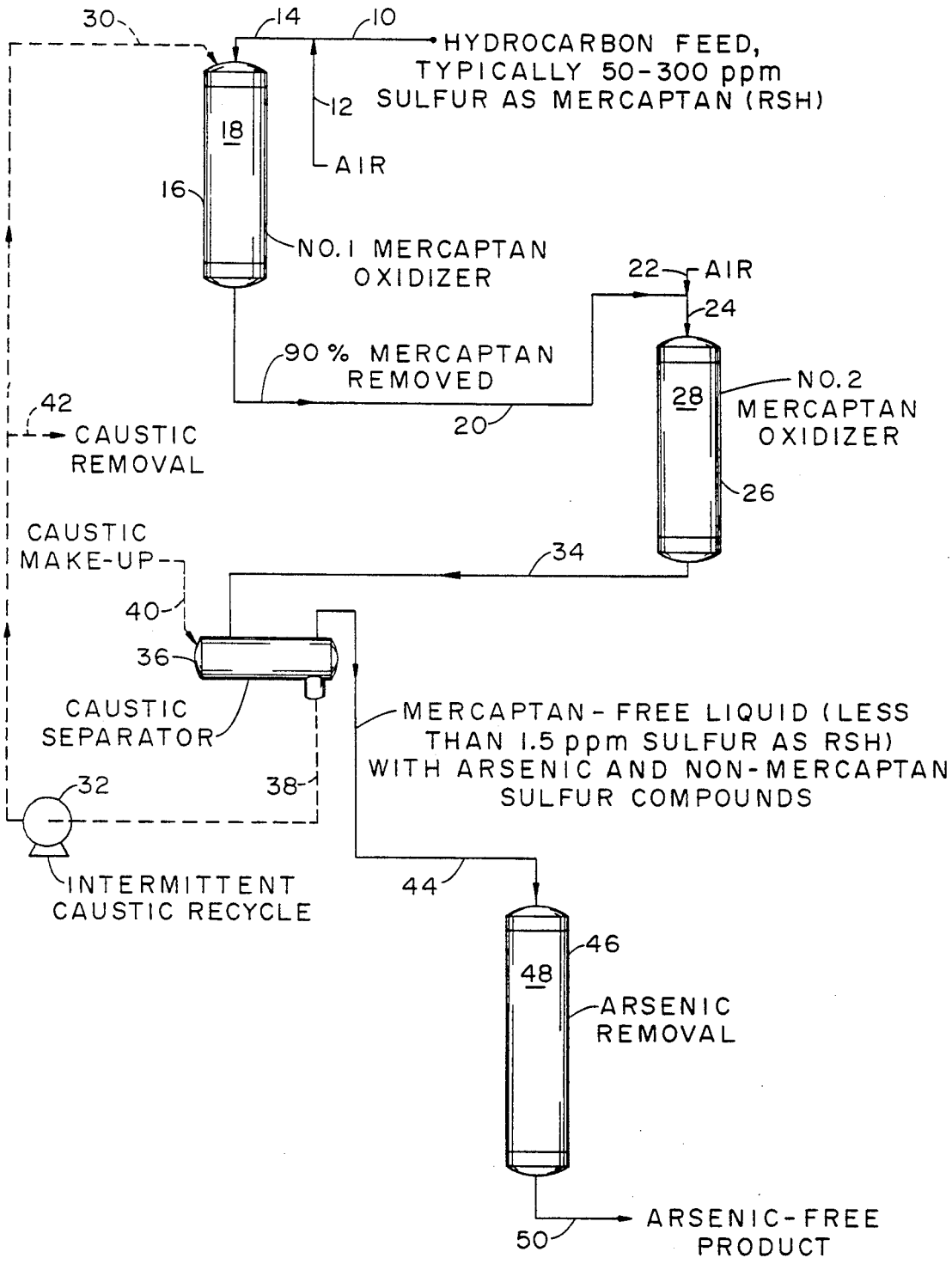
30
14
10
HYDROCARBON FEED, TYPICALLY 50-300 ppm SULFUR AS MERCAPTAN (RSH)
12
AIR
18
16
NO. 1 MERCAPTAN OXIDIZER
22
AIR
24
90 % MERCAPTAN REMOVED
28
NO. 2 MERCAPTAN OXIDIZER
42
CAUSTIC REMOVAL
20
26
CAUSTIC MAKE-UP
34
40
36
CAUSTIC SEPARATOR
MERCAPTAN-FREE LIQUID (LESS THAN 1.5 ppm SULFUR AS RSH) WITH ARSENIC AND NON-MERCAPTAN SULFUR COMPOUNDS
32
38
INTERMITTENT CAUSTIC RECYCLE
44
46
48
ARSENIC REMOVAL
50
ARSENIC-FREE PRODUCT

REMOVAL OF ARSENIC COMPOUNDS FROM LIGHT HYDROCARBON STREAMS

This application is a continuation-in-part of copending application Serial No. 738,204, filed July 30, 1991.

BACKGROUND OF THE INVENTION

1. Field of the Invention

This invention relates to the removal of arsenic compounds from light hydrocarbonaceous streams which contain arsenic and mercaptan sulfur compounds. The feedstock stream can be a petroleum derived naphtha or it can be a synthetic naphtha derived from shale oil, coal liquefaction, tar sands, etc. The naphtha boiling range can be broadly 90°–450° F., more usually 100°–400° F., or as used in the following tests 140°–380° F.

The feedstock can also be liquefied petroleum gas (LPG), nominally liquefied propane. Still another suitable feedstock can be light liquid hydrocarbons in the $C_3$–$C_5$ range. In general, the feedstock can be any hydrocarbonaceous liquid containing arsenic and mercaptan sulfur compounds wherein the mercaptans are susceptible to catalytic oxidation to form organic disulfides.

Various crude oils, such as Taching (China) crude, West Texas crudes, certain Russian crudes, etc., have arsenic compounds as contaminants along with the more normal impurities which contain the elements sulfur, nitrogen and oxygen. When a naphtha cut is distilled from crude containing arsenic, the naphtha also contains arsenic compounds. The naphtha will also contain organic sulfur compounds such as mercaptans, organic sulfides and organic disulfides.

There are many well known and practiced methods for eliminating sulfur compounds from naphthas. However, there are no known methods for removing arsenic compounds in the presence of sulfur compounds from naphtha. Feed naphthas to ethylene plants including furnaces and downstream catalytic reactors should be substantially free of trace arsenic (20–2000 parts per billion) (PPB) and yet contain organic sulfur compounds to be ideal ethylene feed stocks. The reason there is no previously known method for removing arsenic without removing sulfur is that arsenic removal catalysts are also active for sulfur removal. The sulfur is usually present in a much higher concentration level than is the arsenic and so it deprives the catalyst of arsenic removal capacity.

Downstream arsenic as arsine passes through purification units and poisons noble metal catalysts. Arsenic is a serious poison in these units even at 50 PPB levels. Also, arsenic deposits on high temperature naphtha cracker tube surfaces to cause coke build-up, "hot" tubes, tube failure, reduced production and reduced product selectivity.

On the other hand, organic sulfur is a desirable impurity in feed naphthas to ethylene furnaces (steam-naphtha cracking). It passivates nickel-cobalt-containing metal alloy tubes at temperatures in the range 1600°–1800° F. so that destructive hydrogenolysis and/or undesired cracking reactions, including demethanation, do not take place. The organic sulfur is thermally converted in the tubes to $H_2S$ which sulfides the metal surface, thereby passivating the surface and making it inert to the reaction environment. The sulfur must be continually replaced at the tube surface and, therefore, it must be fed continuously as a component of the feedstock, suitably at a concentration of several hundred parts per million.

Naphtha which is rendered free of arsenic can be used as other preferred feedstocks and products, for example:

(a) Feed to Pt catalytic reforming where As is a serious poison.

(b) Gasoline blending.

(c) Feed to noble metal catalyst pretreating.

(d) Feed for $C_5$ and $C_6$ isomerization using Pt/Pd catalysts.

2. Description of the Prior Art

As stated, there is no known prior art relating to the selective removal of arsenic compounds from hydrocarbons in the presence of organic sulfur compounds. This applies to gas, gas-liquids (LPG) and liquid hydrocarbons, such as naphtha and light distillates.

U.S. Pat. Nos. 3,782,076, 3,789,581, 3,542,669 and 4,849,577 relate to arsenic removal in the absence of organic sulfur contamination.

Known catalysts or sorbents for removal of arsenic include $PbO/Al_2O_3$, $CuO/gammaAl_2O_3$ and $CuO/ZnO/gammaAl_2O_3$. These materials remove or react with $H_2S$, COS, RSH (mercaptans), and $AsH_3$.

Normally, other methods are used to remove $H_2S$ and RSH whenever possible because such other methods are cheaper, thus leaving AsH3 and COS clean up for the sorbents listed above. All of these impurities would otherwise compete with each other for sorption by the arsenic sorbents.

U.S. Pat. Nos. 3,782,076 and 4,849,577 as well as an article Remove Arsine to Protect Catalyst, N. L. Carr, D. L. Stahlfeld and H. G. Robertson, *Hydrocarbon Processing*, May 1985, pages 100–102, all relate to processes for removal of arsenic from hydrocarbon streams. However, none of these background processes relate to a problem regarding mercaptan and non-mercaptan sulfur compounds in catalyst deactivation during the arsenic removal process.

SUMMARY OF THE INVENTION

It has now been discovered that a low gamma $Al_2O_3$, or a substantially gamma $Al_2O_3$-free, arsenic sorbent, such as $CuO/ZnO/Al_2O_3$ (10% gamma $Al_2O_3$) selectively removes arsenic compounds from naphtha, but not non-mercaptan sulfur compounds which have been found to remain after either caustic wash to remove mercaptans or catalytic oxidation of mercaptans to disulfides.

Even though aqueous caustic wash removes mercaptan sulfur compounds selectively over organic sulfide compounds, it is shown below that caustic washing alone cannot lower the mercaptan content of a naphtha stream sufficiently that mercaptan sulfur is not the primary sorbed material in the catalyst compared to arsenic. In accordance with this invention a plural stage (preferably two stage) mercaptan removal operation is employed, with mercaptans being catalytically oxidized in each stage. The two stage mercaptan oxidation operation converts mercaptans to disulfides in each stage to provide a substantially mercaptan-free naphtha stream (containing no more than 1.5 PPM, and preferably 1 PPM, mercaptan sulfur by weight) for the subsequent arsenic removal stage. There is about a 90 percent or more mercaptan reduction in the first stage. When the feed to the arsenic removal stage contains no more than 1.5 PPM, or preferably 1 PPM, sulfur as mercaptan, the product effluent from the arsenic removal stage will be substantially arsenic-free.

The catalytic oxidation of mercaptans contained in hydrocarbon streams is a commonly used industrial process. The process is often called "sweetening". Normally the mercaptan level of the "sweet" product is set at about 4 ppm sulfur as mercaptan. This level of mercaptan will normally pass the Doctor sweetening test specification for several refinery streams, such as naphtha. The names of two such commercial process are (1) the Merox process offered by UOP, and (2) the Mercapfining process offered by Howe-Baker.

The catalytic oxidation of mercaptans can employ a catalyst known as cobalt phthalocyanine disulfonate. It can be a homogeneous catalyst dissolved in aqueous sodium hydroxide. Or, the catalyst agent can be dispersed on a solid, porous charcoal carrier or support, and used as a fixed bed reactor. This is the preferred mode of operation in this invention, and it will be explained in more detail. In both cases, the following reaction takes place:

$$2\ RSH + \tfrac{1}{2}\ O_2 \rightarrow RS\text{-}SR + H_2O$$

The process steps of this invention provide a highly synergistic combination. In the combination, a plurality (preferably two) of sulfur removal stages are employed with reactant mixing and and supplemental oxygen addition between stages which selectively remove mercaptan sulfur without removing non-mercaptan sulfur to provide a substantially mercaptan-free (less than 1.5 PPM or 1 PPM sulfur as mercaptan) arsenic-removal feedstock. The arsenic-removal feedstock is passed over a catalytic arsenic sorbent whose arsenic removal capacity would be used up by mercaptans but is not used up by non-mercaptan organic sulfide compounds so that a substantially arsenic-free naphtha product containing organic sulfide compounds is obtained from a catalyst which experiences very little deactivation from sulfur compounds. The effluent from the arsenic removal zone is a highly suitable feedstock for a naphtha steam cracking process.

High alumina arsenic removal catalysts, such as PbO/gamma$Al_2O_3$, containing 80 weight percent alumina, remove significant amounts of non-mercaptan sulfur compounds. Such catalysts are not useful in this invention because the feedstock for these catalysts contain significant amounts of non-mercaptan organic sulfur compounds. These feedstocks contain RSR and RSSR compounds in concentrations about 1000 fold greater than the concentration of arsenic compounds. Such high alumina arsenic sorbents are therefore not useful for arsenic removal in accordance with this invention.

The present invention is based in first part upon the discovery that certain arsenic removal catalysts (e.g. low alumina level catalysts) are highly selective regarding the type of sulfur compounds which they remove. It was discovered that these catalysts tend to remove mercaptans together with arsenic compounds but tend to allow organic sulfides and disulfides to pass through the reactor without removal.

The present invention is based in second part upon the additional discovery that certain processes for the conversion of sulfur compounds in hydrocarbon oils are highly selective towards the conversion of mercaptan compounds to disulfides, without removing or converting organic sulfides or disulfides themselves.

The present invention is based upon the synergistic combination of the above arsenic-removal and mercaptan-conversion processes to provide an economic arsenic removal process without creating an excessive mercaptan waste disposal problem.

In order for the sulfur conversion and the arsenic removal steps to work in synergy, not only must the hydrocarbon stream passed to the arsenic removal stage be substantially free of mercaptans but also the arsenic removal catalyst must be substantially unaffected by non-mercaptan sulfur compounds, such as sulfides and disulfides. The latter feature is especially important, because the sulfur conversion stages employ catalytic oxidation which enhances disulfide content in the hydrocarbon stream. The catalytic oxidation stages do not lower the sulfur content in the hydrocarbon stream but rather convert mercaptan sulfur to disulfide sulfur. This invention is further based upon the discovery that the arsenic removal catalyst must be either substantially alumina free or comprise a low level of alumina, i.e. below 20 or below 10 or 15 weight percent alumina. A preferred arsenic removal catalyst comprises CuO/ZnO/gamma$Al_2O_3$, where the alumina content is about 10 weight percent. The low level of alumina in the arsenic removal catalyst is critical because it is the alumina content which determines the capability of the arsenic removal catalyst to sorb organic sulfides. Alumina has a small capacity for arsenic removal. Therefore, the alumina content of the arsenic removal catalyst only needs to be high enough to impart physical coherency to the catalyst.

A series of tests was made to illustrate this invention. Two arsenic removal catalysts were employed in these tests, having weight percentage compositions as follows:

| |
|---|
| Catalyst A |
| 20% PbO |
| 80% gamma $Al_2O_3$ |
| Manufacturer: Calsicat |
| Catalyst B |
| 40% CuO |
| 50% ZnO |
| 10% gamma $Al_2O_3$ |
| Manufacturer: BASF |

The tests were performed using a virgin naphtha feedstock having the following specifications. No specific analysis was made for $H_2S$ in the naphtha.

| | |
|---|---|
| Naphtha source | Taching crude |
| Vol. % naphtha on crude | 10.7 |
| °API | 57.2 |
| Specific gravity | 0.7499 |
| Total sulfur, PPM | 212 |
| Arsenic, PPB | 190 |
| Marcaptan sulfur, PPM | 47 |
| Non-mercaptan sulfur, PPM | 165 |
| $H_2S$, ppm wt. | <1 |
| ASTM IBP | 140° F. |
| D-86, °F. EP | 380° F. |

EXAMPLE 1

The above virgin naphtha was washed with caustic (NaOH/aq.) with the following results.

| | Virgin Naphtha | Caustic Washed | Percent Removal |
|---|---|---|---|
| As, PPB | 190 | 55 | 71 |
| S, total, PPM | 212 | 165 | |
| S, as RSH, PPM | 47 | <3 | Above 94 |
| S, as non-RSH, PPM | 165 | 165 | 0 |

The above data show that caustic washing of virgin naphtha removes 71 percent of the arsenic and more than 94 percent of mercaptan sulfur, without removing non-mercaptan sulfur. However, the caustic washed naphtha is unsuitable for feed to an arsenic sorbent catalytic zone wherein the sorbent will remove both mercaptan sulfur and arsenic because on a comparable basis the mercaptan sulfur content is <3,000 PPB compared to an arsenic content of only 55 PPB. The following example shows that non-mercaptan sulfur will not be sorbed on the arsenic sorbent.

EXAMPLE 2

The caustic washed naphtha recovered from Example 1 was batch reactor treated with Catalyst A and Catalyst B, according to the following tests.

| | Catalyst A | Catalyst B | Catalyst A | Catalyst B |
|---|---|---|---|---|
| | Sorbent Type | | | |
| As, PPB | <5 | <5 | <5 | <5 |
| S, total, PPM | 100 | 166 | 124 | 159 |
| S, as RSH, PPM | <3 | <3 | <3 | <3 |
| Temperature, °F. of Treatment | 150 | 150 | 75 | 75 |
| Sorbent/Naphtha weight ratio | 0.15 | 0.15 | 0.15 | 0.15 |
| | Weight Percent Removal | | | |
| % non-RSH removal | 40 | 0 | 25 | 0 |
| % As removal | 100 | 100 | 100 | 100 |

The above data show that Catalyst A and Catalyst B are both effective for arsenic removal. However, the data also show that Catalyst A (80% gamma $Al_2O_3$) removed non-mercaptan sulfur but Catalyst B (10% gamma $Al_2O_3$) did not remove non-mercaptan sulfur. Because sulfur competes with arsenic for sorbent sites, Catalyst A is not a catalyst of this invention. On the other hand, Catalyst B, which does not permit non-mercaptan sulfur to compete with arsenic for catalyst sites, is a catalyst of this invention. Based on catalyst B, a suitable composition range for the catalyst of the arsenic sorption stage is:

| | Weight Percent | | |
|---|---|---|---|
| | Min. | Preferred | Max. |
| CuO | 20 | 40 | 75 |
| gamma $Al_2O_3$ | 0 | 10 | 20 |
| ZnO | 25 | 50 | 65 |

The above table shows that an arsenic sorbent having acceptable resistance to non-mercaptan sulfur adsorption is characterized by a low gamma $Al_2O_3$ content, or an absence of alumina, i.e. an gamma $Al_2O_3$ content up to about 20 weight percent.

EXAMPLE 3

Samples of the caustic washed naphtha of Example 1 were subjected to continuous flow testing using catalyst B of this invention under the following conditions.

| | Run 1 | Run 2 |
|---|---|---|
| Catalyst | Catalyst B | Catalyst B |
| Catalyst Weight, g | 78.4 | 80 |
| Temperature, °F. | 75–85 | 67–80 |
| LVHSV, vol/vol/h | 6.8 | 6.8 |
| LWHSV, w/w/h | 4.75 | 4.75 |
| Mass Velocity, lb/ft$^2$/s | 0.68 | 0.68 |
| Bed Length, ft | 8 | 8 |
| Bed Diameter (ID), in | ¼ | ¼ |
| Catalyst Size, Mesh | 30–50 | 30–50 |
| Catalyst Bulk Density, lb/ft$^3$ | 66 | 66 |
| Flow Direction | Upflow | Upflow |
| Volumetric feed Rate, ml/h | 507 | 507 |
| Feed Weight Rate, g/h | 380 | 380 |
| Mass of Naphtha Processed, M g | 34.6 | 32.3 |
| Hours of Continuous Operation | 91 | 85 |

EXAMPLE 4

During performance of Run 1 of Example 3, samples of hydrocarbon product effluent were collected at the end of 7 hour intervals and analyzed for arsenic and non-mercaptan sulfur content. Following are the results of these analyses.

| | Naphtha Analysis | |
|---|---|---|
| Time of Sample Hour of Test | Product Arsenic, PPB[3] | Non-mercaptan Sulfur, PPM[3] |
| (Feed[2] | 53 | 156) |
| 14 | 0[1] | 161 |
| 42 | 0 | 149 |
| 70 | 0 | 174 |
| 77 | 0 | 168 |
| 91 | 0 | 174 |
| Average Product | 0 | 165 ± 11 (95% C.L.) |

[1]0 means <5 PPB, the lower limit of the test method. No arsenic breakthrough at top of reactor.
[2]34,600 g. of naphtha was fed over the 91 hour period. The feed was virgin naphtha which was caustic washed and rendered free of mercaptan sulfur.
[3]PPM = parts per million by weight.
PPM—parts per billion by weight.

The above analyses showed complete arsenic removal and no non-mercaptan sulfur removal occurred during Run 1 of Example 3, performed with Catalyst B.

EXAMPLE 5

During performance of Run 2 of Example 3, product analyses were performed to determine the selectivity of the catalyst for both arsenic and mercaptan sulfur, with the following results.

| Run Time Period, Hours | Arsenic PPB | Total Sulfur PPM | Mercaptan Sulfur, PPM |
|---|---|---|---|
| (Feed[2] | 48 | 154 | <5) |
| 7–14 | <5 | 154 | N.D.[1] |
| 78–85 | <5 | 155 | N.D.[1] |

[1]N.D. = Not detected.
[2]32,290 g. of naphtha was fed over a period of 85 hours. The naphtha was caustic washed and the caustic wash effluent contained about 5 PPM mercaptan sulfur.

The above data shows that caustic washed naphtha is not a suitable feed for the arsenic removal zone because of the approximately 5 PPM mercaptan sulfur content. 5 PPM mercaptan sulfur is about 100 times greater than the 48 PPB arsenic content in the feed to the sorbent zone. Furthermore, the above data show that the arsenic sorbent was at least as active for mercaptan sulfur removal as it was arsenic removal, showing that mercaptan sulfur is a competitor with arsenic for arsenic sorbent capacity.

EXAMPLE 6

Data were taken on the CuO/ZnO/gamma $Al_2O_3$ catalyst bed of Run 2 of Example 3 to show the end-of-run arsenic distribution along the length of the bed. Run 2 used a naphtha feed having 48 PPB arsenic and <5 PPM mercaptan sulfur. Following are the sorbed profile data obtained.

| Distance Along Catalyst Bed, % of Bed | Distribution Of Arsenic (As) Along Bed, As Fraction Of As Fed | Fraction of Sulfur Fed As Mercaptan Sulfur Deposited On Catalyst |
|---|---|---|
| 0–5 | 0.396 | 0.33 |
| 5–10 | 0.270 | 0.22 |
| 10–15 | 0.167 | 0.13 |
| 15–20 | 0.167 | 0.12 |
| 20–25 | 0 | 0.11 |
| 25–30 | 0 | 0.09 |
| 30–100 | 0 | 0 |
| | 1.000 | 1.00 |

The above data show that mercaptan sulfur in the naphtha feed is sorbed on the bed, acquiring active catalyst sites and thereby interfering with sorption of arsenic. The above data show that because of the relative concentrations of arsenic and mercaptan sulfur in the naphtha feed, there was a frontal behavior competition advantage in the catalyst bed in favor of the mercaptan sulfur over the arsenic because the mercaptan sulfur deposit occupied about 30 percent of the bed while the arsenic deposit occupied only 20 percent of the bed. Thereby, bed failure will ultimately be caused by the mercaptan sulfur content in the naphtha before it would be caused by the arsenic content.

The above data in column 3 of Example 6 show in a most rigorous test that non-mercaptans do not sorb on the catalyst at all. The critical fact is that the zero sulfur content of the used catalyst was found in the 30 to 100 percent position of the bed. This entire portion was in contact with naphtha having a non-mercaptan sulfur concentration of 165 PPM. The analytical test for sulfur on the catalyst which was used is very sensitive and it shows that none of this type of sulfur compound sorbs on the catalyst.

PROCESS FOR SELECTIVE REMOVAL OF ARSENIC FROM LIQUID HYDROCARBON

The present invention charges a naphtha as described above through two fixed-bed catalytic oxidation zones in series to accomplish conversion of mercaptans (RSH) to disulfides so that the mercaptan sulfur content of the naphtha is less than about 1 ppm wt. sulfur as RSH, followed by arsenic removal from the product of the oxidation stages by passing the stream over a fixed bed of an arsenic sorbent or catalyst, such as CuO/ZnO/-gamma$Al_2O_3$, in weight proportions of 40/50/10, respectively.

Detailed procedures for each of the three steps are presented below. Each step is described in a generic sense and can be followed for any scale of operation or feed rate selected including bench-scale to large-scale continuous operation.

PROCEDURE FOR PREPARATION OF OXIDATION CATALYST AND OPERATION OF OXIDATION REACTORS

The catalytic oxidation of mercaptans present in a hydrocarbon feedstock is carried out in a packed-bed reactor. The catalyst can comprise cobalt phthalocyanine disulfonate (abbreviated CoPC) impregnated onto a suitable high-surface area activated carbon, which acts as a support for the real catalytic agent CoPC. This supported catalyst is prepared in a known manner by impregnation of the CoPC onto the carbon surface by percolation of an aqueous solution of CoPC over the bed of carbon. This aqueous solution is passed through the bed of carbon particles until the adsorptive capacity of the carbon for the cobalt is reached throughout the catalyst bed.

A quantity of the soluble catalytic agents is first dissolved in water to produce a 10 percent Co as cobalt phthalocyanine disulfonate solution concentration. Other concentrations may be used. The amount of solution is chosen to be in 10 percent excess of that required for loading the catalyst onto the support. The expected Co loading is about 0.1 to 1.0 percent Co-on-carbon, depending on the adsorptive capacity of the carbon. Typically, about 0.1 percent Co loading would be adequate for an active catalyst. The percolation is continued by liquid recycle from the outlet to the inlet until the adsorptive capacity is reached for the carbon.

When the catalyst is prepared in this way, it is essentially ready for use after being given a water-wash percolation (down flow) to remove any remaining cobalt phthalocyanine disulfonate left in solution in the bed interstices.

Following are suitable specification values for the oxidation catalyst.

1. Activated Carbon
   Surface area, >800 $M^2/g$
   Size, 30–40 mesh (pilot plant), 4–8 mesh (commercial)
   Pore volume, 0.5–0.7 vol./vol.
   Pore Size, 90% 20–1000 °A
2. Percolation conditions for preparation
   Temperature, 50°–100° F.
   Pressure, 1 atmosphere
   Downflow solution, distributed over top of bed
3. Saturation of carbon with cobalt phthalocyanine disulfonate until the outflow solution's cobalt content matches the 10 percent Co inflow content.
4. The finished catalyst is CoPC chemisorbed on activated carbon. The percent Co as CoPC should be the saturation level for this compound which is normally about 0.1–1.0 percent Co. 0.1 percent is typical.

Following are suitable specifications for the oxidation reactions for treating $H_2S$-free naphthas containing 100 ppm-wt. S as RSH in order to produce a product containing ≦1.5 ppm S as RSH. Adjustment of LVHSV can be made to suit other feed mercaptan contents or other feedstocks.

1. LVHSV (volume feed / hr / volume reactor).
   Reactor 1: 4.3 (90% conversion)
   Reactor 2: 4.3 (90% conversion)
   Overall: 2.2 (99+% conversion of mercaptan feed)

2. Temperature, °F.
   Range: 70–130
   Preferred: 100
3. Pressure, psig.
   Range: 50–500
   Preferred: 200
4. Length/diameter ratio for reactors
   Range: 4–10
   Preferred: 6 (commercial)
5. Feed saturated with air at conditions given above.

The following table illustrates the space velocity variation required to achieve ≦1.5 or 1 ppm sulfur as RSH, based on the above conditions, for selected levels of mercaptan sulfur contents of the feed.

| Percent RSH Conversion in Each Reactor | Initial (Feed) Mercaptan Sulfur Content, ppm | LVHSV Each Reactor |
|---|---|---|
| 85.8 | 50 | 5.1 |
| 90.0 | 100 | 4.3 |
| 91.9 | 150 | 3.9 |

The sulfur content at the outlet of the first reactor ($C_1$) is simply related to the feed sulfur content ($C_o$) for the case of equal reactor sizes and at the outlet concentration of 1 ppm of mercaptan sulfur:

$$C_1=\sqrt{C_o}$$

Similarly, conversion is obtained by the following formula:

$$\chi = \left| \frac{C_o - C_1}{C_o} \right| \times 100$$

This applies to both reactors when operated at the same LVHSV (liquid volume per hour per volume of reactor).

The conversion varies with LVHSV according to the model:

$$\chi = 100(1 - \exp(-9.9/LVHSV))$$

The rate constant, 9.9, applies to naphtha. Other parameter values would depend on the hydrocarbon boiling range, temperature, oxygen partial pressure and catalyst activity. The values shown are typical for naphtha.

Two reactors in series give an overall conversion of mercaptan higher than one reactor. In reactor operation, there is a reactant forward axial dispersion effect, which is a tendency of reactants to advance ahead of the ideal plug flow front, which would result in inefficient by-pass of catalyst leading to lower conversion for said reactor, which becomes important to reactor performance when the conversion is necessarily high, such as 99 percent and higher. The concept of axial dispersion is described in the text by Octave Levenspiel, *Chemical Reaction Engineering*, John Wiley & Sons, Inc. 1962, at pages 260 to 280, which pages are hereby incorporated by reference. This effect makes the slippage of the reactant higher and the conversion lower. This effect is greatly offset in accordance with this invention by using two reactors in a series, with oxygen or air injection between the stages, so that nearly plug-flow performance is achieved over all. The series reactor arrangement with interstage air injection according to this invention accomplishes interstage mixing of reactants to avoid dispersion of reactants as would occur in a single stage and enriches the system with oxygen reactant and is therefore a critical requirement to achieve 99+percent removal of mercaptans, so that the product RSH sulfur level stays at 1.5 ppm wt., or lower.

The overall chemical reaction in the two stage selective oxidation of mercaptans (denoted as RSH) to disulfides is as follows:

$$4\,RSH + \underset{(air)}{O_2} \xrightarrow[\text{CoPc catalyst}]{OH^-} 2\,RSSR + 2\,H_2O$$

R represents a hydrocarbon group (radical) which may be aliphatic, aromatic or cyclic, and saturated or unsaturated. The source of $OH^-$ ions can be caustic soda, i.e. aqueous NaOH. The CoPC catalyst is preferably cobalt phthalocyanine disulfonate impregnated on activated carbon or charcoal. The oxygen source is air, injected into the hydrocarbon stream ahead of each reactor in the amount sufficient only to saturate the hydrocarbon with air at the prevailing conditions. RSSR depicts a disulfide.

PREPARATION OF ARSENIC SORBENT

The catalyst used in the tests of this application for arsenic removal is catalyst R3-12 obtained from BASF Catalysts of Parsippany, N.J.

An effective catalyst can be prepared by deposition of copper from a solution, preferably aqueous, of a suitable salt of copper such as cupric nitrate followed by calcining the dried composite in the presence of air at elevated temperatures to produce a ZnO/gamma$Al_2O_3$, support for a copper oxide catalyst. The calcination conditions are selected such that the surface area of the support is not impaired or reduced.

The amount of copper so dispersed is effective from 5–50 wt. percent and preferably about 40 wt. percent of the total finished sorbent, as copper oxide. Examples of suitable supporting materials are the porous natural or synthetic high surface area catalyst supports, i.e., over 50 $m^2/g$ refractory oxides which are well known in the art. However, for purposes of selective arsenic removal in the presence of organic sulfur compounds which are non-mercaptans, the preferable support is ZnO. Up to 10 percent of gamma $Al_2O_3$ enhances the support properties, but greater amounts of alumina in the total sorbent tend to reduce its selectivity for arsenic over sulfur compounds, and the preferable final composition of the sorbent is:

| Component | Wt. Percent |
|---|---|
| CuO | 40 |
| ZnO | 50 |
| gamma $Al_2O_3$ | 10 |
| | 100 |

It is a discovery of this invention that the CuO and ZnO does not sorb non-mercaptan organic sulfur compounds, but that gamma $Al_2O_3$ does sorb organic sulfur compounds other than mercaptans. It is important that no material be employed in the catalyst of the arsenic removal stage in an amount above 20 weight percent if that material is capable of significant sorption of non-mercaptan sulfur compounds.

Following is a description of the preparation of a copper oxide material supported on a high surface area mixture of ZnO and gamma $Al_2O_3$, 83.3 percent and 16.7 percent, respectively, in their initial states. The support mixture is first calcined at a temperature of about 1,000° F. in air. The mixed powder is a normal 5–250 μm particle size after calcining for about six hours. An aqueous solution of saturated $Cu(NO_3)_2.3H_2O$ (cupric nitrate hydrate) in distilled water is prepared at 195° F. (90° C.). The cupric nitrate hydrate is prepared by reducing the hexahydrate by heating to 30° C. before mixing with water. 1,200 g of the cupric nitrate is dissolved in 100 g water at 195° F. with stirring. Then 600 g of the prepared support (ZnO/gammaAl$_2$O$_3$) is added with mixing and/or mix-mulling. The incipient wetness absorptivity of the dry support is about 1 ml/g of solid. The wet material is then dried with mixing for 12 hours at 250° F. The dried powder is then calcined with air in a kiln or its equivalent by raising the temperature to about 1,000° F. over a period of six hours, and holding that temperature for another ten hours. The final calcined composite contains about 40 wt. percent CuO.

The final powder is then pelleted to a suitable size, such as ⅛ inches diameter by ⅛ inches in length. The sorbent is now ready for use in the process.

THE ARSENIC REMOVAL REACTOR

The arsenic removal reactor follows the second or final mercaptan oxidation stage. Following are the characteristics of the liquid stream flowing to the arsenic removal reactor.

| Properties | General Range | Specific Example |
|---|---|---|
| Arsenic Content ppb, wt. | 10–1,000 | 190 |
| Mercaptan Sulfur ppm, wt. | ≦1 | 0.5 |
| Non-Mercaptan Sulfur, ppm, wt. | 50–1,000 | 165 |
| $H_2S$, ppm, wt. | <1 | 0 |
| Carbonyl Sulfide ppm, wt. | 0–2 | 0 |
| As + S Loading wt. percent | 2–10 | 5 |
| Petroleum cut | LPG - Kerosine | Naphtha |

The objective of the arsenic removal reactor is to reduce the arsenic content of the stream to less than 5 ppb., wt. Although the normal purpose of this reactor is not for removal of other compounds, it will also remove traces of hydrogen sulfide, carbonyl sulfide and mercaptans.

The following design conditions are given for general use and for the specific example. The conditions apply to the preferred catalyst having a weight 40/50/10 CuO/ZnO/gammaAl$_2$O$_3$ composition.

| Description | General Range | Specific Example |
|---|---|---|
| Temperature, °F. | 50–200 | 100 |
| Pressure | ← above bubble point → | |
| LVHSV, vol/vol/h | 1–5 | 1 |
| LWHSV, w/w/h | 0.7–3.4 | 0.7 |
| Mass Velocity, lb/ft$^2$/s | 0.4–2 | 0.7 |
| Reactor L/D | 5–10 | 7 |
| Flow Direction | ← Downflow → | |

-continued

| Description | General Range | Specific Example |
|---|---|---|
| Months of Operation | 6–60 | 48 |

These results for the specific example show that under the basic conditions given, the operating life of the sorbent is expected to be 48 months or about 4 years. The sorbent would remove both the arsenic and mercaptan sulfur, at 190 and 500 ppb, wt., respectively, before break through of these contaminants at the bottom of the reactor. Alternately, for example, the liquid space velocity could be doubled and the operating time would be halved, to 24 months. Thus, the design choice is flexible by means of the space velocity and catalyst life trade-off.

Increasing temperature increases the useful life of the catalyst, but this effect is not readily estimated. (Refer to Carr, et al. publication in Hydrocarbon Processing). Conversely, if the amount of mercaptan were roughly doubled in the feed, i.e., poorer performance in the first oxidation stage, the life of the catalyst would be halved, approximately. This shows the critical nature of the performance of the oxidation reactors.

BRIEF DESCRIPTION OF DRAWING

The process of this invention is illustrated in the accompanying figure wherein a hydrogen sulfide-free liquid hydrocarbon feed typically containing 50–300 PPM sulfur as mercaptan together with arsenic compounds and non-mercaptan sulfur compounds is charged through line 10 and is saturated with air entering through line 12 and the mixture then passes through line 14 to a first mercaptan oxidizer reactor 16 containing fixed bed 18 of activated carbon particles impregnated with CoPC. A first oxidizer effluent stream having 90 percent or more of its mercaptan sulfur removed is recovered through line 20 and becomes thoroughly mixed in line 20 and then saturated with air entering through line 22 before entering a second mercaptan oxidizer 26 having fixed bed 28 of catalyst similar to the catalyst contained in first oxidizer 16.

Dilute caustic for catalyst activation is circulated intermittently to reactor 16 through line 30 by means of caustic pump 32. The effluent from second mercaptan oxidizer 26 containing caustic flowing in line 34 is passed to caustic separator 36. Caustic is removed from separator 36 through line 38 and passed to pump 32. Make-up caustic enters the system through line 40 and excess caustic can be removed from the system through line 42.

A hydrocarbon stream containing 1.5 PPM or less of sulfur as mercaptan together with arsenic and non-mercaptan sulfur compounds is withdrawn from caustic separator 36 through line 44 and passed to arsenic removal reactor 46 containing fixed bed 48 of arsenic removal catalyst sorbent CuO/ZnO/10% gammaAl$_2$O$_3$. A substantially arsenic-free product (less than 5 PPB-wt.) is removed from reactor 46 through line 50 for further treatment in conventional refinery processes.

I claim:

1. A process for the removal of arsenic from a feed liquid hydrocarbon stream containing arsenic together with mercaptans and organic sulfide and disulfide compounds comprising passing said hydrocarbon stream to a plurality of catalytic oxidations stages in series with air added to the hydrocarbon stream before the first stage and between the stages for selectively oxidizing the mercaptans to disulfides, recovering an oxidation effluent hydrocarbon stream containing organic sulfide and disulfide compounds with no more than 1.5 part per million by weight of sulfur as mercaptan, passing the oxidation effluent hydrocarbon stream to a catalytic arsenic removal stage containing a sorbent catalyst which removes arsenic and remaining mercaptan sulfur substantially without removing sulfur from organic sulfide and disulfide compounds.

2. The process of claim 1 wherein said oxidation effluent hydrocarbon stream contains no more than one part per million by weight of sulfur as mercaptan.

3. The process of claim 1 wherein there are two catalytic oxidation stages.

4. The process of claim 1 wherein the arsenic removal stage catalyst comprises less than 20 weight percent gamma alumina.

5. The process of claim 1 wherein the catalyst in the oxidation stages comprises a fixed bed of cobalt phthalocyanine disulfonate on activated carbon.

6. The process of claim 1 wherein the arsenic removal stage catalyst comprises CuO on a ZnO support, with no more than 20 weight percent alumina as an additional support.

7. The process of claim 1 including charging an aqueous caustic stream to the catalytic oxidation stages for catalyst activation.

8. The process of claim 1 wherein said feed hydrocarbon stream comprises petroleum naphtha.

9. The process of claim 1 wherein said feed hydrocarbon stream is a material selected from the group consisting of liquified petroleum gas, butanes and pentanes.

10. The process of claim 1 wherein said feed hydrocarbon stream comprises coal liquefaction naphtha.

11. The process of claim 1 wherein said feed hydrocarbon stream comprises shale oil naphtha.

12. The process of claim 1 wherein said feed hydrocarbon stream comprises tar sands naphtha.

13. The process of claim 1 wherein said feed hydrocarbon stream comprises naphtha with trace $H_2S$.

14. The process of claim 1 wherein the arsenic removal stage catalyst is selected from the group consisting of PbO/ZnO/gamma$Al_2O_3$ and CuO/ZnO/gamma$Al_2O_3$, wherein the gamma $Al_2O_3$ is no more than 20 percent of the catalyst weight.

15. The process of claim 1 wherein the arsenic removal stage catalyst contains less than 15 weight percent gamma alumina.

16. The process of claim 1 wherein the arsenic removal stage catalyst contains less than 10 weight percent gamma alumina.

17. The process of claim 1 wherein the arsenic removal stage catalyst is substantially gamma alumina-free.

18. The process of claim 1 which produces a hydrocarbon product containing less than 5 PPB by weight of arsenic.

19. A process for the removal of arsenic from a naphtha liquid feed stream containing arsenic together with mercaptans and organic sulfide and disulfide compounds comprising passing said naphtha stream and air to two catalytic oxidation stages in series wherein mercaptans are selectively converted to disulfides to produce a lower mercaptan stream containing no more than 1.5 parts per million sulfur by weight as mercaptan, passing said lower mercaptan stream to a catalytic arsenic removal stage having an arsenic removal catalyst comprising less than 20 weight percent gamma alumina which removes arsenic and remaining mercaptan sulfur from the stream substantially without removal of non-mercaptan sulfur compounds and recovering an effluent stream having reduced arsenic compared to the arsenic in the feed stream.

20. The process of claim 19 wherein said low mercaptan stream contains no more than one part per million by weight sulfur as mercaptan.

21. The process of claim 19 wherein said effluent stream contains substantially the same amount of sulfur as contained in the feed stream.

22. The process of claim 19 wherein the arsenic removal stage catalyst comprises CuO/ZnO/gamma$Al_2O_3$.

23. The process of claim 19 wherein there is greater than 99 percent conversion of mercaptan sulfur to disulfide sulfur in the catalytic oxidation stages.

24. The process of claim 19 wherein the arsenic content in the effluent stream is less than 5 PPB.

25. A process for the removal of arsenic from a feed liquid hydrocarbon stream containing arsenic together with mercaptans and organic sulfide and disulfide compounds comprising passing said hydrocarbon stream with air to a catalytic oxidation zone for selectively oxidizing mercaptans to disulfides, recovering an oxidation effluent hydrocarbon stream containing organic sulfide and disulfide compounds with no more than 1.5 part per million by weight of sulfur as mercaptan, passing the oxidation effluent hydrocarbon stream to a catalytic arsenic removal stage containing a sorbent catalyst which removes arsenic and remaining mercaptan sulfur substantially without removing sulfur from organic sulfide and disulfide compounds.

26. The process of claim 25 wherein there is greater than 99 percent conversion of mercaptan sulfur to disulfide sulfur in the catalytic oxidation zone.

27. The process of claim 25 wherein said oxidation effluent stream contains no more than one part per million by weight of sulfur as mercaptan.

28. The process of claim 25 wherein the arsenic removal stage catalyst comprises less than 20 weight percent gamma alumina.

29. The process of claim 25 wherein the catalyst in the catalytic oxidation zone comprises a fixed bed of cobalt phthalocyanine disulfonate on activated carbon.

30. The process of claim 25 wherein the arsenic removal stage catalyst comprises CuO and a ZnO support, with no more than 20 weight percent alumina as an additional support.

31. The process of claim 25 including charging an aqueous caustic stream to the catalytic oxidation zone for catalyst activation.

32. The process of claim 25 wherein the feed liquid hydrocarbon stream comprises petroleum naphtha.

33. The process of claim 25 wherein the feed liquid hydrocarbon stream is a material selected from the group consisting of liquified petroleum gas, butanes and pentanes.

34. The process of claim 25 wherein the feed liquid hydrocarbon stream is selected from the group of coal liquefaction naphtha, shale oil naphtha and tar sands naphtha.

35. The process of claim 25 wherein the feed hydrocarbon stream comprises naphtha with trace $H_2S$.

36. The process of claim 25 wherein the arsenic removal stage catalyst is selected from the group consisting of PbO/ZO/gamma $Al_2O_3$ and CuO/ZnO/gamma $Al_2O_3$, wherein the gamma $Al_2O_3$ is more than 20 percent of the catalyst weight.

37. The process of claim 25 wherein the arsenic removal stage catalyst contains less than 15 weight percent gamma alumina.

38. The process of claim 25 wherein the arsenic removal stage catalyst contains less than 10 weight percent gamma alumina.

39. The process of claim 25 wherein the arsenic removal stage catalyst is substantially gamma alumina-free.

40. The process of claim 25 which produces a hydrocarbon product containing less than 5 PPB by weight of arsenic.

* * * * *

UNITED STATES PATENT AND TRADEMARK OFFICE

CERTIFICATE OF CORRECTION

PATENT NO. : 5,169,516

DATED : December 8, 1992

INVENTOR(S) : NORMAN L. CARR

It is certified that error appears in the above-indentified patent and that said Letters Patent is hereby corrected as shown below:

ON THE TITLE PAGE:

At [56] References Cited, change "Boitisux" to --Boitiaux--.

Column 2, line 22, change "$PbO/Al_2O_3$" to --$PbO/gammaAl_2O_3$--.

Column 6, line 49, Example 4, footnote 3, change second occurrance of PPM to --PPB--.

Column 11, line 41, delete the underlining under the word "Non-Mercaptan".

Signed and Sealed this

Fourth Day of January, 1994

*Attest:*

*Attesting Officer*

BRUCE LEHMAN

*Commissioner of Patents and Trademarks*